US008864088B2

(12) United States Patent
Funderburk

(10) Patent No.: US 8,864,088 B2
(45) Date of Patent: Oct. 21, 2014

(54) BRACKET FOR WOOD SHELVING

(71) Applicant: Grizzly Bracket Holdings, LLC, Charlotte, NC (US)

(72) Inventor: Jeffrey V. Funderburk, Indian Trail, NC (US)

(73) Assignee: Grizzly Bracket Holdings, LLC, Charlotte, NC (US)

( * ) Notice: Subject to any disclaimer, the term of this patent is extended or adjusted under 35 U.S.C. 154(b) by 0 days.

(21) Appl. No.: 13/650,348

(22) Filed: Oct. 12, 2012

(65) Prior Publication Data

US 2013/0037669 A1 Feb. 14, 2013

Related U.S. Application Data

(63) Continuation of application No. 29/392,848, filed on May 26, 2011, now Pat. No. Des. 671,396.

(51) Int. Cl.
*A47G 29/02* (2006.01)
*A47B 96/06* (2006.01)

(52) U.S. Cl.
CPC ..... *A47B 96/061* (2013.01)
USPC ..... 248/250; 248/235; 211/90.01

(58) Field of Classification Search
USPC ..... 211/87.01, 90.01, 16, 88.04, 88.01; 248/235, 240.3, 247, 248, 250
See application file for complete search history.

(56) References Cited

U.S. PATENT DOCUMENTS 2,065,133 A 12/1936 Heppenstall
D168,431 S 12/1952 Yellin
2,991,038 A 7/1961 Vitiello
D201,502 S 6/1965 Nieman
4,457,239 A 7/1984 Heinze
5,044,137 A * 9/1991 Shigeru et al. ..... 52/286

(Continued)

FOREIGN PATENT DOCUMENTS

GB 2 160 086 A 12/1985
GB 2 190 281 A 11/1987
WO WO 2004/000068 A1 12/2003

OTHER PUBLICATIONS

Wrought Iron Bear Shelf Brackets: black bear shelf holders: black shelf brackets; Downloaded from http://www.wroughtironhaven.com/shop/wrought-iron-bear-shelf-brackets.html; Downloaded on Oct. 1, 2012; 1 page.

(Continued)

*Primary Examiner* — Alfred J Wujciak
(74) *Attorney, Agent, or Firm* — Alston & Bird LLP

(57) ABSTRACT

Brackets for shelving and related systems are provided herein. An example bracket for shelving includes a main body defining first and second lower support features each configured to receive a respective first and second piece of wood in a vertical orientation such that a top surface of the first piece of wood and a top surface of the second piece of wood align to form a lower shelf support surface for supporting a lower shelf. The main body further defines first and second upper support features each configured to receive a respective third and fourth piece of wood in a vertical orientation such that a top surface of the third piece of wood and a top surface of the fourth piece of wood align to form an upper shelf support surface for supporting an upper shelf. The main body may also define a decorative feature, such as a bear-shaped cutout.

20 Claims, 6 Drawing Sheets

(56) References Cited

U.S. PATENT DOCUMENTS

| | | | | |
|---|---|---|---|---|
| D325,399 | S | 4/1992 | Alexander | |
| 5,295,754 | A * | 3/1994 | Kato | 403/174 |
| 5,485,933 | A | 1/1996 | Crooymans | |
| 5,613,312 | A * | 3/1997 | Crowell | 40/312 |
| 5,921,049 | A * | 7/1999 | Sugiyama | 52/653.1 |
| D418,742 | S | 1/2000 | Emmett | |
| D419,429 | S | 1/2000 | Emmett | |
| 6,032,431 | A * | 3/2000 | Sugiyama | 52/656.9 |
| D446,953 | S | 8/2001 | Isom | |
| 6,303,195 | B1 | 10/2001 | Reynolds et al. | |
| 6,520,119 | B1 * | 2/2003 | Johnson | 119/705 |
| D512,805 | S | 12/2005 | Anderson | |
| 7,007,905 | B2 | 3/2006 | Roberts | |
| 8,151,939 | B2 * | 4/2012 | Osborne | 182/155 |
| 2004/0124036 | A1 * | 7/2004 | Ulshafter, Jr. | 182/153 |

OTHER PUBLICATIONS

Scroll Saw Shelves—Deer Shelf; Downloaded from http://www.thewinfieldcollection.com/product/Deer_Shelf/Scroll_Saw_Shelves; Downloaded on Oct. 1, 2012; 1 page.

Anywhere Log Furniture—Indoor Products; Log Shelf with Deer Accents; Downloaded from http://www.anywherelogfurniture.com/in-outproducts.html; Downloaded on Oct. 1, 2012; 4 pages.

Martha Stewart Living™ Solutions Country Bracket with Shelf—Martha Stewart Living; Downloaded from http://www.homedecorators.com/P/Martha_Stewart_Living_Solutions_Country_Bracket_ . . . ; Downloaded on Oct. 1, 2012; 1 page.

CRL Clear Lucite 2—Shelf Decorative Multi-Shelf Brackets—CRL Lucite and Acry . . . ; Downloaded from http://www.dkhardware.com/product-30797-lb120-clear-lucite-2-shelf-decorative-multi-sh . . . ; Downloaded on Oct. 1, 2012; 1 page.

Cabela's: Wrought Iron Shelf Brackets—Per Pair; Downloaded at http://www.cabelas.com/product/Wrought-Iron-Shelf-Brackets-Per-Pair/719646.uts?Ntk= . . . ; Downloaded on Oct. 1, 2012; 1 page.

Hello, navel. Blogs—Archinect; Downloaded from http://archinect.com/blog/article/21449913/hello-navel; Downloaded on Oct. 1, 2012; 1 page.

Knotty Ideas Woodworking Shelf—Facebook; Downloaded from http://www.facebook.com/media/set/?set=a.143922722308004.16947.113374968696113& . . . ; Downloaded on Oct. 1, 2012; 1 page.

Rustic Shelf Bracket —Bear; Bear Shelf Brackets; Downloaded from http://www.cabinplace.com/rusticshelfbracketbear.htm; Downloaded on Oct. 3, 2012; 1 page.

* cited by examiner

BRACKET FOR WOOD SHELVING

RELATED APPLICATIONS

The present invention is a Continuation of U.S. patent application Ser. No. 29/392,848, filed May 26, 2011, entitled "Shelf Bracket," which is incorporated by reference in its entirety.

FIELD OF THE INVENTION

Embodiments of the present invention relate generally to brackets and, more particularly, relate to brackets for wood shelving.

BACKGROUND

Whether in a home, at work, in a garage, or in a shed, storage options are desirable. Shelving provides one such storage option that is useful for many spaces. In some cases, brackets are designed to hang on a wall and provide support for mounting a shelf thereon. However, there is a need for improved brackets for shelving, including a need for inexpensive and aesthetically pleasing brackets.

SUMMARY OF THE INVENTION

As such, embodiments of the present invention provide an improved bracket for shelving. In some embodiments, the bracket may be configured for wood shelving and may enable a user to easily hang multiple wood shelves with standard-sized wood. Additionally, in some embodiments, decorative features may be provided on the bracket for an aesthetic benefit.

In one example embodiment, a bracket for wood shelving is provided. The bracket comprises a main body defining a first lower support feature configured to receive a first piece of wood in a vertical orientation. The main body further defines a second lower support feature configured to receive a second piece of wood in a vertical orientation such that a top surface of the first piece of wood and a top surface of the second piece of wood align to form a lower shelf support surface for supporting a lower shelf. The main body further defines a first upper support feature configured to receive a third piece of wood in a vertical orientation. The main body further defines a second upper support feature configured to receive a fourth piece of wood in a vertical orientation such that a top surface of the third piece of wood and a top surface of the fourth piece of wood align to form an upper shelf support surface for supporting an upper shelf.

In some embodiments, the first and second lower support features and first and second upper support features are each configured to receive a standard-sized piece of wood. In some embodiments, the first lower support feature is configured to receive a 2×6 piece of wood and the second lower support feature is configured to receive a 2×4 piece of wood such that the top surface of the 2×6 piece of wood extends in the same plane as the top surface of the 2×4 piece of wood.

In some embodiments, the first and second lower support features and first and second upper support features each define a bottom surface and at least one sidewall so as to form a channel.

In some embodiments, the main body further defines a decorative feature. Additionally, in some embodiments, the decorative feature defines a bear-shaped cutout. Additionally or alternatively, in some embodiments, a lower portion of the decorative feature defines the first and second lower support features. For example, in some embodiments, the first and second lower support features are each defined by a leg of a bear-shaped cutout.

In another example embodiment, a system for forming an upper wood shelf and a lower wood shelf is provided. The system comprises a first bracket and a second bracket that each include a main body. The main body defines a first lower support feature configured to receive a first piece of wood in a vertical orientation. The main body further defines a second lower support feature configured to receive a second piece of wood in a vertical orientation such that a top surface of the first piece of wood and a top surface of the second piece of wood align to form a lower shelf support surface for supporting the lower wood shelf. The main body further defines a first upper support feature configured to receive a third piece of wood in a vertical orientation. The main body further defines a second upper support feature configured to receive a fourth piece of wood in a vertical orientation such that a top surface of the third piece of wood and a top surface of the fourth piece of wood align to form an upper shelf support surface for supporting the upper wood shelf.

In some embodiments, the first bracket and second bracket are each configured to be hung on a wall with a free span therebetween. Additionally, in some embodiments, the free span extends up to eight feet.

In some embodiments, the first and second lower support features and first and second upper support features of each of the first and second bracket are each configured to receive a standard-sized piece of wood. In some embodiments, the first lower support feature of the first bracket is configured to receive a first end of a 2×6 piece of wood. The first lower support feature of the second bracket is configured to receive a second opposing end of the 2×6 piece of wood. The second lower support feature of the first bracket is configured to receive a first end of a 2×4 piece of wood. The second lower support feature of the second bracket is configured to receive a second opposing end of the 2×4 piece of wood. The top surface of the 2×6 piece of wood extends in the same plane as the top surface of the 2×4 piece of wood.

In some embodiments, the first and second lower support features and first and second upper support features of each of the first and second bracket each define a bottom surface and at least one sidewall so as to form a channel.

In some embodiments, the main body of each of the first and second bracket further defines a decorative feature. Additionally, in some embodiments, the decorative feature of each of the first and second bracket defines a bear-shaped cutout. Additionally or alternatively, in some embodiments, a lower portion of the decorative feature of each of the first and second bracket defines the first and second lower support features. For example, in some embodiments, the first and second lower support features of each of the first and second bracket are each defined by a leg of a bear shape.

In another example embodiment, a bracket for wood shelving is provided. The bracket includes a main body configured to support an upper wood shelf and a lower wood shelf. The main body comprises a decorative feature defining a first lower support feature configured to receive a first piece of wood. The decorative feature further defines a second lower support feature configured to receive a second piece of wood such that a top surface of the first piece of wood and a top surface of the second piece of wood align to form a lower shelf support surface for supporting the lower wood shelf.

In some embodiments, the decorative feature defines a bear-shaped cutout and the first and second lower support features are each defined by a leg of the bear-shaped cutout.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Shelving is a useful storage option for many spaces. For example, shelves may be useful for garages, basements, sheds, and the like. Some shelving can be hung from a wall to enable storage, and, in some cases, display, of items. Indeed, in some cases, two or more brackets may be hung on a wall such that the brackets define a support surface for shelving to be mounted thereon.

Along these lines, some embodiments of the present invention provide one or more brackets for mounting to a wall to form a support surface of wood shelving. Moreover, the brackets may be specifically designed to form shelves with standard-sized pieces of wood. In such a regard, an easy and inexpensive shelving system is provided.

Shelving may be formed of many different types of material, such as wood, plastic, metal, among others. As used herein, while some example embodiments describe use of a bracket with wood shelving, some embodiments of the present invention may be useful with any type of material. As such, embodiments of the present invention are not meant to be limited to wood as a material for the shelf. For example, a bracket that may be configured to fit a standard-sized piece of wood may, in some cases, be configured to fit a similarly sized piece of metal (or other material).

Additionally, in some cases, it may be desirable for the shelving to be decorative. As such, some embodiments of the present invention provide for brackets with at least one decorative feature, such as a bear-shaped cutout.

Figure 8:
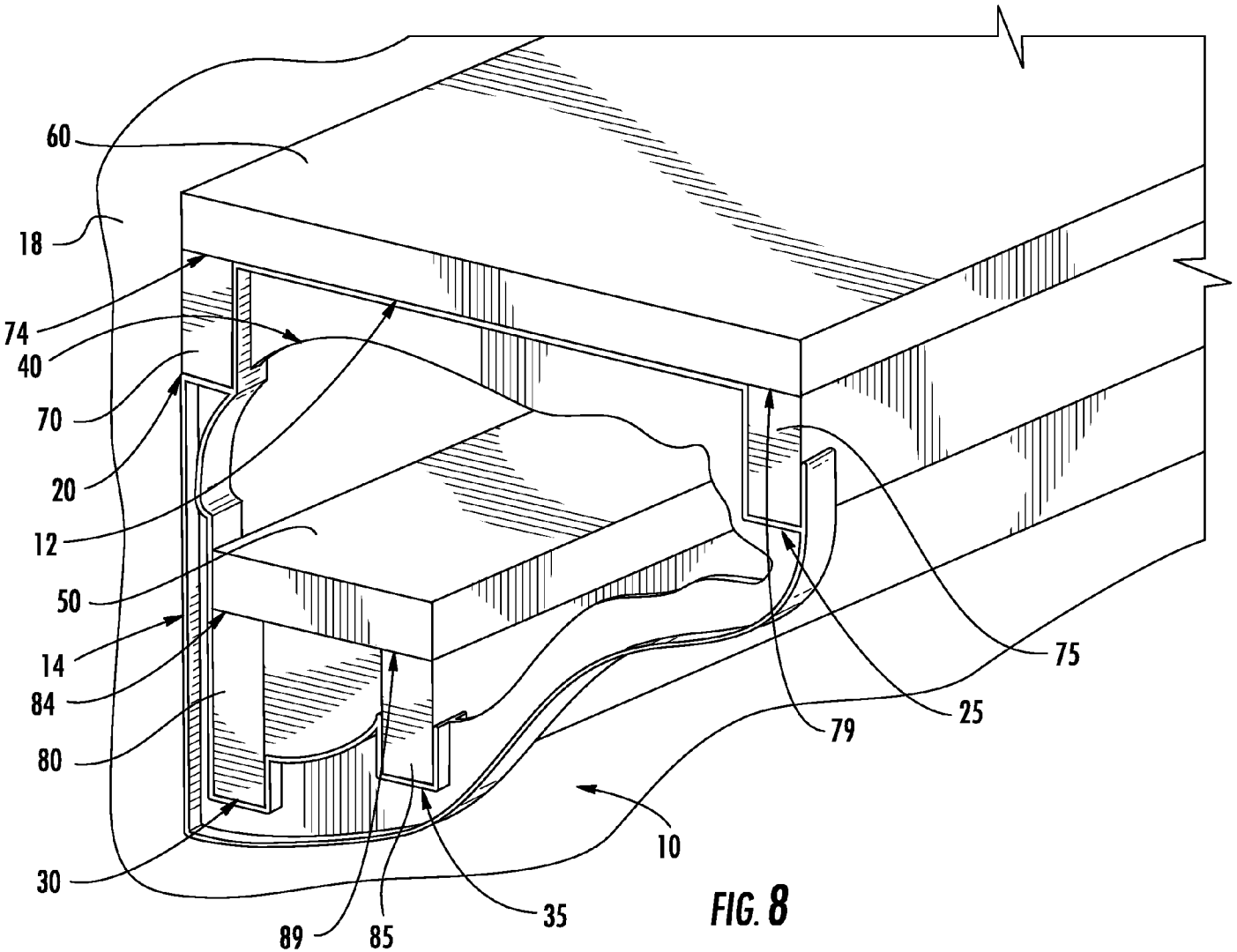
FIG. 8 shows a perspective view of the bracket shown in FIG. 1 with an upper and lower wood shelf being supported thereby, in accordance with some example embodiments discussed herein.

FIGS. 1-7 illustrate an example bracket for shelving. The bracket 10 comprises a main body 13 with a top surface 12, a mounting surface 14, and a side surface 15. The bracket 10, with reference to FIG. 8, may be configured to mount to a wall 18. For example, in some embodiments, the bracket 10 may be configured mount to a wall 18 with fasteners (e.g., screws, nails, etc.) through one or more apertures (not shown) on the mounting surface 14.

In some embodiments, the bracket may comprise a main body that defines support features for receiving pieces of wood, or other material. As described in greater detail herein, the pieces of wood may be used to form shelving. In the depicted embodiment, the bracket 10 comprises a main body 13 that defines a first upper support feature 20 and a second upper support feature 25. The main body 13 also defines a first lower support feature 30 and a second lower support feature 35.

In such a regard, the bracket may be configured to support an upper and lower shelf. For example, with reference to FIG. 8, the bracket 10 may be configured to support an upper wood shelf 60 and a lower wood shelf 50. In the depicted embodiment, as described in greater detail herein, the upper wood shelf 60 and the lower wood shelf 50 are pieces of wood that are positioned over, and supported by, other pieces of wood that are engaged by a respective support feature of the bracket 10.

In such a regard, in some embodiments, each support feature of the bracket may define a channel that is configured to receive a piece of wood. For example, with reference to FIG. 1, the first lower support surface 30 may define a bottom surface 30*a*, a first sidewall 30*b*, and a second sidewall 30*c* that form a channel for receiving a piece of wood. In such a manner, in some embodiments, with reference to FIG. 8, the first lower support feature 30 may be configured to receive a first piece of wood 80. In the depicted embodiment, the first lower support feature 30 is configured to receive a 2×6 piece of wood 80. In such a regard, the channel of the first lower support feature 30 may define a width of at least 2 inches. However, in some embodiments, the first lower support feature 30 may be configured to receive any standard-sized piece of wood (or other material). Along these lines, the first lower support feature may be configured to receive any size piece of material.

Figure 1:
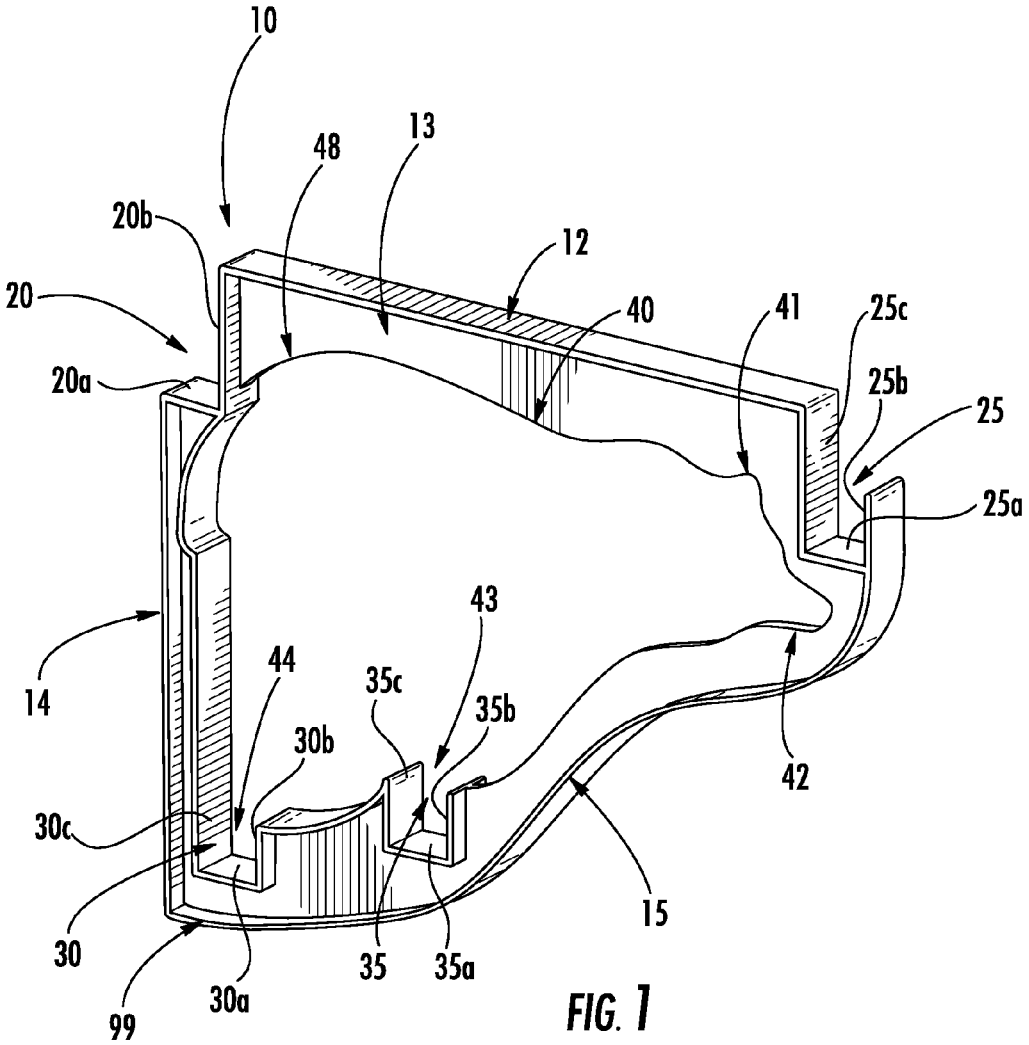
FIG. 1 shows a perspective view of a bracket for shelving, in accordance with some example embodiments discussed herein.
Figure 2:
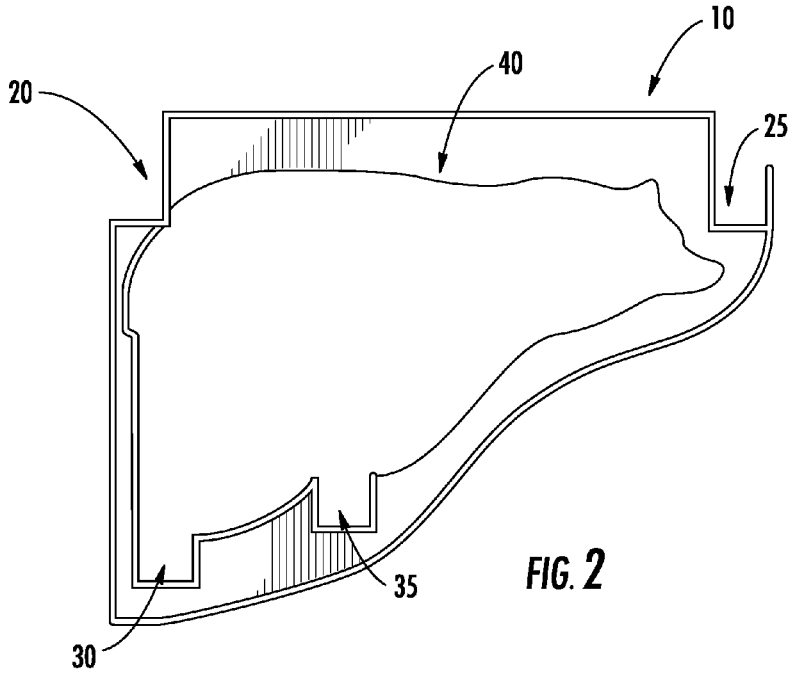
FIG. 2 shows a left view of the bracket shown in FIG. 1, in accordance with some example embodiments discussed herein.
Figure 3:
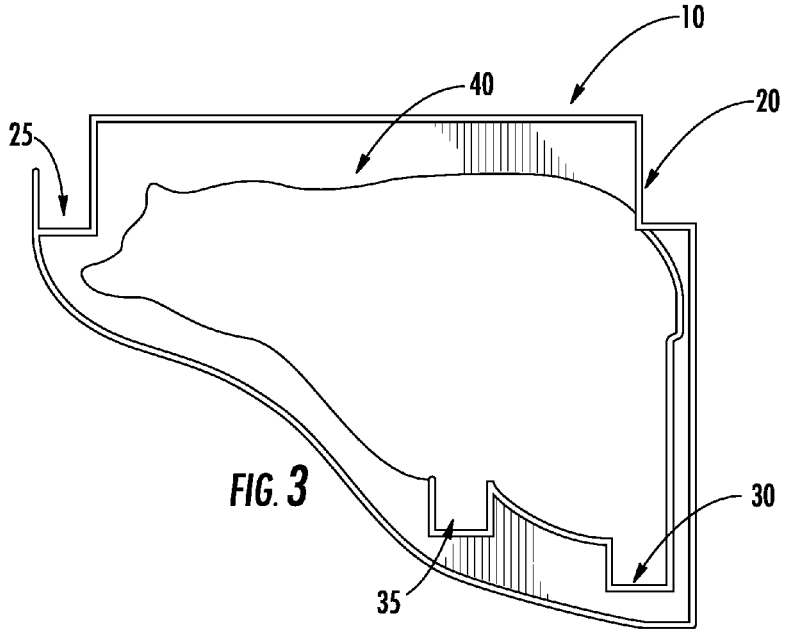
FIG. 3 shows a right view of the bracket shown in FIG. 1, in accordance with some example embodiments discussed herein.
Figure 4:
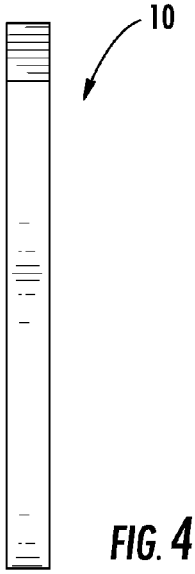
FIG. 4 shows a front view of the bracket shown in FIG. 1, in accordance with some example embodiments discussed herein.
Figure 5:
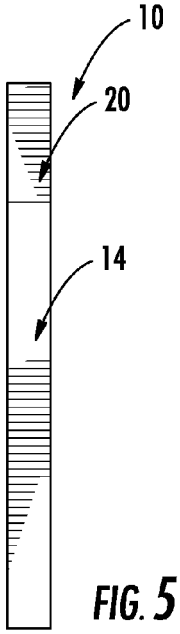
FIG. 5 shows a back view of the bracket shown in FIG. 1, in accordance with some example embodiments discussed herein.
Figure 6:
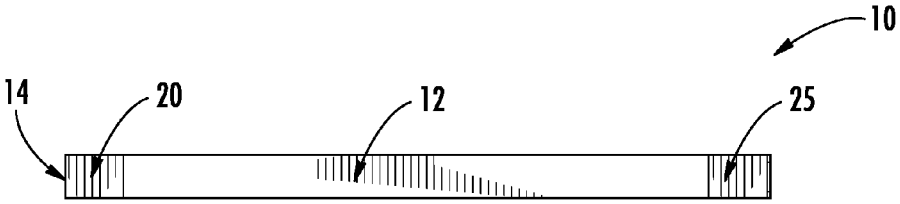
FIG. 6 shows a top view of the bracket shown in FIG. 1, in accordance with some example embodiments discussed herein.
Figure 7:
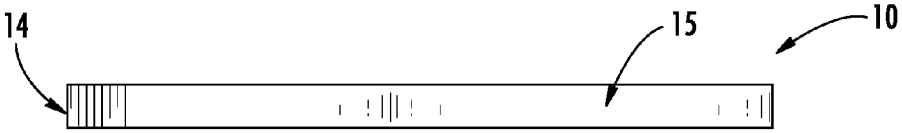
FIG. 7 shows a bottom view of the bracket shown in FIG. 1, in accordance with some example embodiments discussed herein.

Along similar lines, with reference to FIG. 1, the second lower support surface 35 may define a bottom surface 35*a*, a first sidewall 35*b*, and a second sidewall 35*c* that form a channel for receiving a piece of wood. In such a manner, in some embodiments, with reference to FIG. 8, the second lower support feature 35 may be configured to receive a second piece of wood 85. In the depicted embodiment, the second lower support feature 35 is configured to receive a 2×4 piece of wood 85. In such a regard, the channel of the second lower support feature 35 may define a width of at least 2 inches. However, in some embodiments, the second lower support feature 35 may be configured to receive any standard-sized piece of wood (or other material). Along these lines, the second lower support feature may be configured to receive any size piece of material.

In some embodiments, the bracket may define first and second lower support features that are configured to receive pieces of wood such that a top surface of the first piece of wood (received by the first lower support feature) and a top surface of the second piece of wood (received by the second lower support feature) align to form a lower shelf support surface for supporting the lower shelf. Additionally, in some embodiments, the bracket may define first and second lower support features that are configured to receive pieces of wood in a vertical orientation such that a top surface of the first piece of wood (received by the first lower support feature) and a top surface of the second piece of wood (received by the second lower support feature) align to form a lower shelf support surface for supporting the lower shelf. For example, with reference to FIG. 8, the first lower support feature 30 is configured to receive a 2×6 piece of wood 80 and the second lower support feature 35 is configured to receive a 2×4 piece of wood 85. Due to the height difference between the first lower support feature 30 and the second lower support feature 35 and the corresponding height difference between the 2×6 piece of wood 80 and 2×4 piece of wood 85 respectively, the top surface 84 of the 2×6 piece of wood 80 and the top surface 89 of the 2×4 piece of wood 85 align (e.g., extend in the same plane) to form a lower shelf support surface for supporting the lower wood shelf 50.

In some embodiments, the bracket may define first and second lower support features such that the lower wood shelf defines a certain depth (e.g., 6 in., 12 in., etc.). For example, in the depicted embodiment, the lower wood shelf 50 defines a depth of 12 inches.

As shown in FIG. 1, the first upper support surface 20 may define a bottom surface 20*a* and a first sidewall 20*b* that form a channel for receiving a piece of wood. Additionally, when the bracket 10 is mounted to the wall 18 (shown in FIG. 8), the bottom surface 20*a*, first sidewall 20*b*, and wall 18 form the channel. In such a manner, in some embodiments, the first upper support feature 20 may be configured to receive a third piece of wood 70. In the depicted embodiment, the first upper support feature 20 is configured to receive a 2×4 piece of wood 70. In such a regard, the channel of the first upper support feature 20 may define a width of at least 2 inches. However, in some embodiments, the first upper support feature 20 is configured to receive any standard-sized piece of wood (or other material). Along these lines, the first upper support feature may be configured to receive any size piece of material.

Along similar lines, with reference to FIG. 1, the second upper support surface 25 may define a bottom surface 25*a*, a first sidewall 25*b*, and a second sidewall 25*c* that form a channel for receiving a piece of wood. In such a manner, in some embodiments, with reference to FIG. 8, the second upper support feature 25 may be configured to receive a fourth piece of wood 75. In the depicted embodiment, the second upper support feature 25 is configured to receive a 2×4 piece of wood 75. In such a regard, the channel of the second upper support feature 25 may define a width of at least 2 inches. However, in some embodiments, the second upper support feature 25 may be configured to receive any standard-sized piece of wood (or other material). Along these lines, the second upper support feature may be configured to receive any size piece of material.

In some embodiments, the bracket may define first and second upper support features that are configured to receive pieces of wood such that a top surface of the third piece of wood (received by the first upper support feature) and a top surface of the fourth piece of wood (received by the second upper support feature) align to form an upper shelf support surface for supporting the upper shelf. Additionally, in some embodiments, the bracket may define first and second upper support features that are configured to receive pieces of wood in a vertical orientation such that a top surface of the third piece of wood (received by the first upper support feature) and a top surface of the fourth piece of wood (received by the second upper support feature) align to form an upper shelf support surface for supporting the upper shelf. For example, with reference to FIG. 8, the first upper support feature 20 is configured to receive a 2×4 piece of wood 70 and the second upper support feature 25 is configured to receive a 2×4 piece of wood 75. In such a regard, the top surface 74 of the 2×4 piece of wood 70 and the top surface 79 of the 2×4 piece of wood 75 align (e.g., extend in the same plane) to form an upper shelf support surface for supporting the upper wood shelf 60. Additionally, in some embodiments, such as the depicted embodiment of FIG. 8, the top surface 12 of the main body 13 of the bracket 10 may be configured to align (e.g., extend in the same plane) with the top surface of the third and fourth pieces of wood to form the upper shelf support surface for supporting the upper shelf.

In some embodiments, the bracket may define first and second upper support features such that the upper wood shelf defines a certain depth (e.g., 12 in., 24 in., etc.). For example, in the depicted embodiment, the upper wood shelf 60 defines a depth of 24 inches.

Though the depicted embodiments illustrate a bracket configured to support an upper and lower shelf, some embodiments of the present invention contemplate a bracket configured to support any number of shelves (e.g., one shelf, three shelves, four shelves, etc.).

In some embodiments, the bracket may comprise a main body that defines a decorative feature. In such a manner, the bracket may become aesthetically pleasing. The decorative feature may be any shape and, in some cases, may be cutout from the main body. For example, with reference to FIG. 1, the main body 13 may define a decorative feature 40 of a bear-shaped cutout. The decorative feature 40 may have distinctive features that cause it to be easily recognizable. For example, the bear-shaped cutout defines a nose 42, an ear 41, a back 48, and legs 43, 44.

In some embodiments, a lower portion of the decorative features may define at least one support feature. For example, in some embodiments, a lower portion of the decorative feature may define the first and second lower support features. For example, leg 44 of the bear-shaped cutout 40 defines the first lower support feature 30. Similarly, leg 43 of the bear-shaped cutout 40 defines the second lower support feature 35.

As noted above, though some example embodiments are described with respect to a bear-shaped cutout, some embodiments of the present invention contemplate any shape or cutout for the decorative feature (e.g., a deer-shaped cutout, a cow-shaped cutout, a bull-shaped cutout, geometric shapes, etc.). Likewise, the lower portion of such shape may define at least one support feature. For example, a deer-shaped cutout may be the decorative feature, and the legs of the deer-shaped cutout may define the first and second lower support features. Along these same lines, multiple geometric shapes may be the decorative feature, and the lower portion of two of the geometric shapes may define the first and second lower support features.

Figure 9:
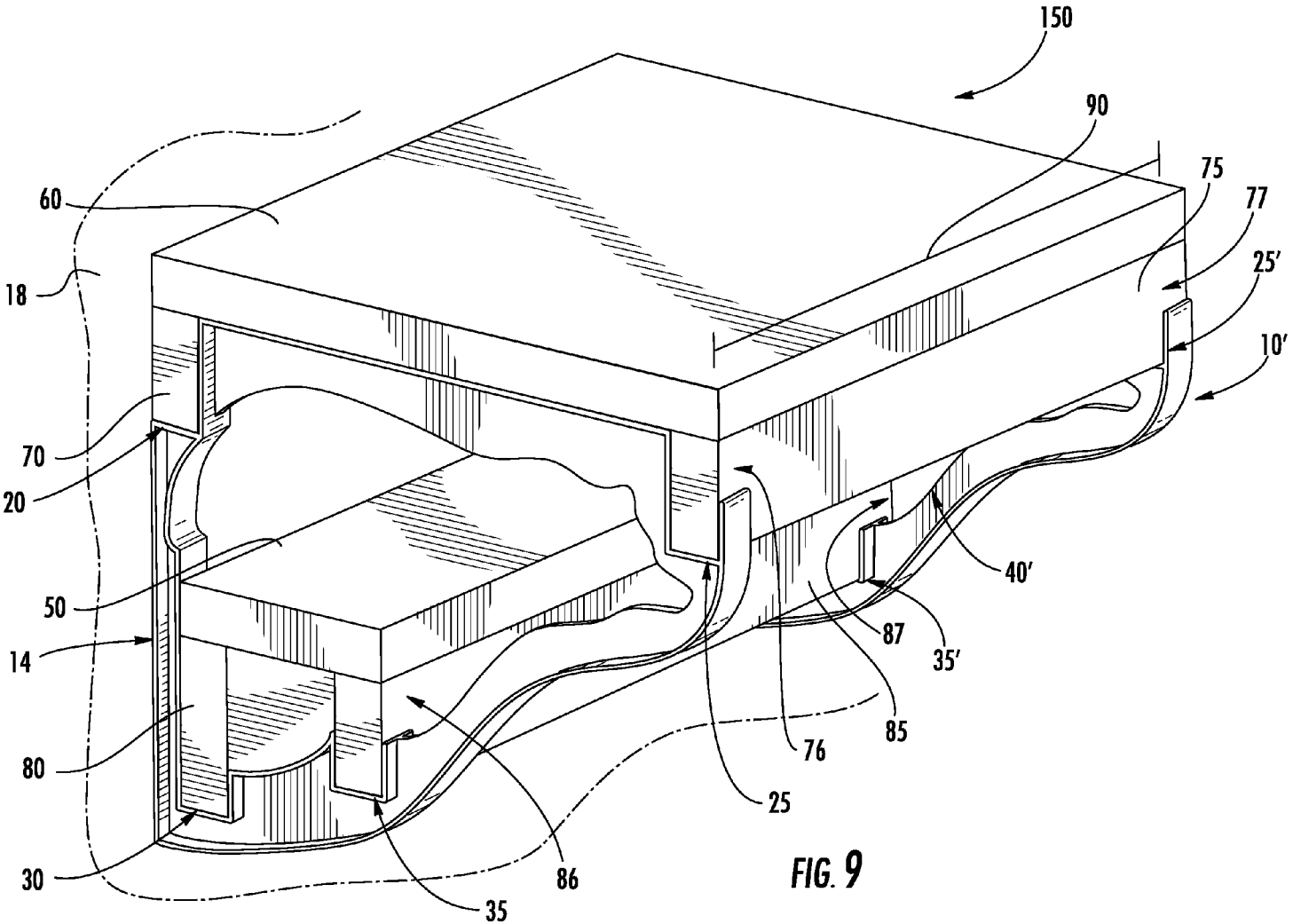
FIG. 9 shows a perspective view of an example wood shelf system, wherein two example brackets support an upper and lower shelf, in accordance with some example embodiments discussed herein.

In some embodiments, a system for forming an upper shelf and lower shelf is provided. The system may comprise at least two brackets (e.g., a first and second bracket). Each bracket may be any embodiment of a bracket described herein. Additionally, the first bracket and second bracket may each be configured to be hung on a wall with a free span therebetween. For example, with reference to FIG. 9, the system 150 may comprise a first bracket 10 and a second bracket 10' hung on a wall 18 with a free span 90 therebetween. In some embodiments, the free span 90 may extend up to 8 feet. Such an embodiment may be useful, as standard-sized pieces of wood are often sold in 8 foot sections.

By hanging the brackets apart, the pieces of wood may be positioned within each support feature such that shelving may be formed. For example, with reference to FIG. 9, the first lower support feature 30 of the first bracket 10 may be configured to receive a first end (not shown) of the first piece of wood 80. The first lower support feature 30' of the second bracket 10' may be configured to receive a second opposing end (not shown) of the first piece of wood 80. The second lower support feature 35 of the first bracket 10 may be configured to receive a first end 86 of the second piece of wood 85 and the second lower support feature 35' of the second bracket 10' may be configured to receive a second opposing end 87 of the second piece of wood 85. Thus, due to the height differences of the respective first and second support features 30, 35 of the first bracket 10 and the first and second support features 30', 35' of the second bracket 10', the top surface 84 of the first piece of wood 80 (a 2×6 piece of wood) aligns (e.g., extends in the same plane) with the top surface 89 of the second piece of wood 85 (a 2×4 piece of wood) to form a lower shelf support surface for supporting the lower wood shelf 50.

Along these lines, the first upper support feature 20 of the first bracket 10 may be configured to receive a first end (not shown) of the third piece of wood 70. The first upper support feature 20' of the second bracket 10' may be configured to receive a second opposing end (not shown) of the third piece of wood 70. The second upper support feature 25 of the first bracket 10 may be configured to receive a first end 76 of the fourth piece of wood 75 and the second upper support feature 25' of the second bracket 10' may be configured to receive a second opposing end 77 of the fourth piece of wood 75. In such a manner, the top surface 74 of the third piece of wood 70 aligns (e.g., extends in the same plane) with the top surface 79 of the fourth piece of wood 75 to form an upper shelf support surface for supporting the upper wood shelf 60.

Though the depicted embodiment includes two brackets spaced apart at the ends of the pieces of wood therebetween, some embodiments of the present invention contemplate placement of the brackets at any point along the pieces of wood (e.g., near the center of the wood). Along these lines, some embodiments of the present invention contemplate more than two brackets being used for the system for supporting shelving. For example, a third bracket may be hung on the wall between the first and second brackets to provide additional support for the pieces of wood and the upper and lower shelves.

In some embodiments, the main body of the bracket may comprise reinforcement structures. Such reinforcement structures may provide extra material for additional support. For example, with reference to FIG. 1, the main body 13 may define a main layer of material. Additionally, a reinforcement structure 99 may be defined around the perimeter of the main body 13 so as to provide additional support. In some embodiments, the reinforcement structure 99 may be positioned anywhere on the main body of the bracket. For example, the reinforcement structure 99 may be positioned around the support features 20, 25, 30, 35 to provide additional support.

Figure 10:
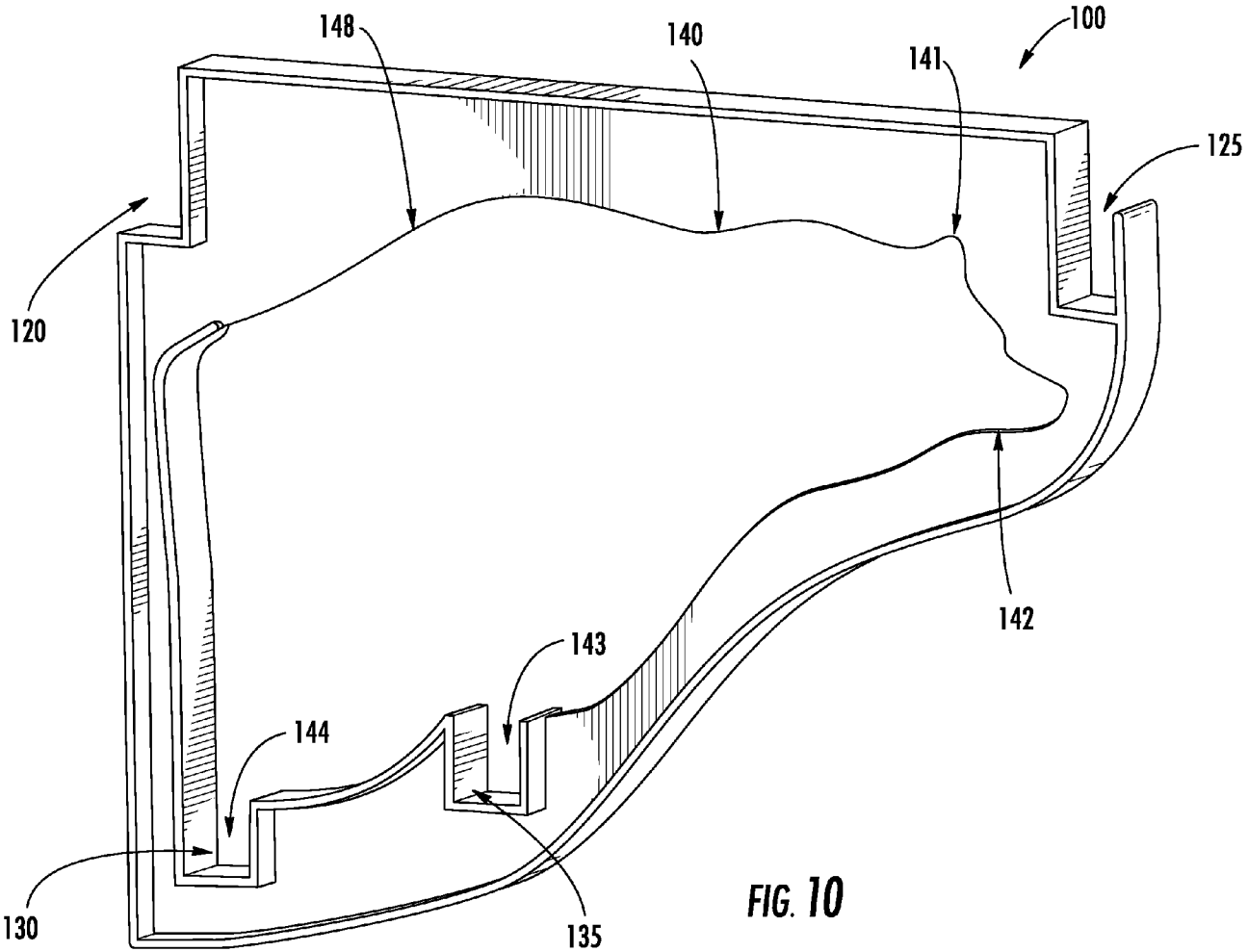
FIG. 10 shows a perspective view of another example bracket for shelving, in accordance with some example embodiments discussed herein.

Along these lines, embodiments of the present invention contemplate differences in the structure of the depicted brackets. Indeed, some embodiments of the present invention contemplate changes in size and location of reinforcement structures, as well as type and amount of material used. For example, with reference to FIG. 10, another example bracket 100 is shown. The depicted bracket 100 includes first and second upper support features 120, 125 and first and second lower support features 130, 135. Additionally, the bracket 100 includes a decorative feature in a bear-shaped cutout 140. The bear-shaped cutout 140 defines a nose 142, an ear 141, a back 148, and two legs 143, 144. Notably, however, as compared to bracket 10, bracket 100 includes additional material proximate the back 148 of the bear-shaped cutout 140. Such additional material may provide support for the shelving that is formed.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included herein. Although specific terms are employed herein, they are used in a generic and descriptive sense only and not for purposes of limitation.

The invention claimed is:

1. A bracket for hanging wood shelving on a wall, the bracket comprising:

a main body defining:

a first lower support feature located at a first vertical position along the main body, wherein the first lower support feature is configured to receive a first piece of wood in a vertical orientation;

a second lower support feature located at a second vertical position along the main body, wherein the first vertical position is different than the second vertical position, wherein the second lower support feature is configured to receive a second piece of wood in a vertical orientation such that a top surface of the first piece of wood and a top surface of the second piece of wood align to form a lower shelf support surface for supporting a lower shelf;

a first upper support feature configured to receive a third piece of wood in a vertical orientation;

a second upper support feature configured to receive a fourth piece of wood in a vertical orientation such that a top surface of the third piece of wood and a top surface of the fourth piece of wood align to form an upper shelf support surface for supporting an upper shelf; and a cutout, wherein the first lower support feature and the second lower support feature are defined within the cutout.

2. The bracket according to claim 1, wherein the first and second lower support features and first and second upper support features are each configured to receive a standard-sized piece of wood.

3. The bracket according to claim 1, wherein the first lower support feature is configured to receive a 2×6 piece of wood and the second lower support feature is configured to receive a 2×4 piece of wood such that the top surface of the 2×6 piece of wood extends in the same plane as the top surface of the 2×4 piece of wood.

4. The bracket according to claim 1, wherein the first and second lower support features and first and second upper support features each define a bottom surface and at least one sidewall so as to form a channel.

5. The bracket according to claim 1, wherein the main body further defines a decorative feature.

6. The bracket according to claim 5, wherein the decorative feature defines a bear-shaped cutout.

7. The bracket according to claim 5, wherein a lower portion of the decorative feature defines the first and second lower support features.

8. The bracket according to claim 7, wherein the first and second lower support features are each defined by a leg of a bear-shaped cutout.

9. A system for forming an upper wood shelf and a lower wood shelf, the system comprising:

a first and second bracket for hanging wood shelving on a wall, the first and second bracket each comprising a main body defining:

a first lower support feature located at a first vertical position along the main body, wherein the first lower support feature is configured to receive a first piece of wood in a vertical orientation;

a second lower support feature located at a second vertical position along the main body, wherein the first vertical position is different than the second vertical position, wherein the second lower support feature is configured to receive a second piece of wood in a vertical orientation such that a top surface of the first piece of wood and a top surface of the second piece of wood align to form a lower shelf support surface for supporting the lower wood shelf;

a first upper support feature configured to receive a third piece of wood in a vertical orientation;

a second upper support feature configured to receive a fourth piece of wood in a vertical orientation such that a top surface of the third piece of wood and a top surface of the fourth piece of wood align to form an upper shelf support surface for supporting the upper wood shelf; and a cutout, wherein the first lower support feature and the second lower support feature are defined within the cutout.

10. The system according to claim 9, wherein the first bracket and second bracket are each configured to be hung on a wall with a free span therebetween.

11. The system according to claim 10, wherein the free span extends up to eight feet.

12. The system according to claim 9, wherein the first and second lower support features and first and second upper support features of each of the first and second bracket are each configured to receive a standard-sized piece of wood.

13. The system according to claim 9, wherein the first lower support feature of the first bracket is configured to receive a first end of a 2×6 piece of wood and the first lower support feature of the second bracket is configured to receive a second opposing end of the 2×6 piece of wood, wherein the second lower support feature of the first bracket is configured to receive a first end of a 2×4 piece of wood and the second lower support feature of the second bracket is configured to receive a second opposing end of the 2×4 piece of wood, and wherein the top surface of the 2×6 piece of wood extends in the same plane as the top surface of the 2×4 piece of wood.

14. The system according to claim 9, wherein the first and second lower support features and first and second upper support features of each of the first and second bracket each define a bottom surface and at least one sidewall so as to form a channel.

15. The system according to claim 9, wherein the main body of each of the first and second bracket further defines a decorative feature.

16. The system according to claim 15, wherein the decorative feature of each of the first and second bracket defines a bear-shaped cutout.

17. The system according to claim 15, wherein a lower portion of the decorative feature of each of the first and second bracket defines the first and second lower support features.

18. The system according to claim 17, wherein the first and second lower support features of each of the first and second bracket are each defined by a leg of a bear shape.

19. A bracket for hanging wood shelving on a wall, the bracket comprising:

a main body defining:

a first lower support feature configured to receive a first piece of wood in a vertical orientation;

a second lower support feature configured to receive a second piece of wood in a vertical orientation such that a top surface of the first piece of wood and a top surface of the second piece of wood align to form a lower shelf support surface for supporting a lower shelf;

a first upper support feature configured to receive a third piece of wood in a vertical orientation;

a second upper support feature configured to receive a fourth piece of wood in a vertical orientation such that a top surface of the third piece of wood and a top surface of the fourth piece of wood align to form an upper shelf support surface for supporting an upper shelf; and a decorative feature defining a bear-shaped cutout, wherein the first and second lower support features are each defined by a leg of the bear-shaped cutout.

20. A system for forming an upper wood shelf and a lower wood shelf, the system comprising:

a first and second bracket for hanging wood shelving on a wall, the first and second bracket each comprising a main body defining:

a first lower support feature configured to receive a first piece of wood in a vertical orientation;

a second lower support feature configured to receive a second piece of wood in a vertical orientation such that a top surface of the first piece of wood and a top surface of the second piece of wood align to form a lower shelf support surface for supporting the lower wood shelf;

a first upper support feature configured to receive a third piece of wood in a vertical orientation;

a second upper support feature configured to receive a fourth piece of wood in a vertical orientation such that a top surface of the third piece of wood and a top surface of the fourth piece of wood align to form an upper shelf support surface for supporting the upper wood shelf; and a decorative feature defining a bear-shaped cutout, wherein the first and second lower support features are each defined by a leg of the bear-shaped cutout.

* * * * *